US011752410B2

(12) United States Patent
Mason et al.

(10) Patent No.: US 11,752,410 B2
(45) Date of Patent: Sep. 12, 2023

(54) FORCE SENSOR FOR ALERTING GOLFER WHEN CLUB HELD TOO TIGHTLY

(71) Applicants: Bradley R. Mason, Rancho Santa Fe, CA (US); Jeffrey T. Mason, Valley Center, CA (US)

(72) Inventors: Bradley R. Mason, Rancho Santa Fe, CA (US); Jeffrey T. Mason, Valley Center, CA (US)

( * ) Notice: Subject to any disclaimer, the term of this patent is extended or adjusted under 35 U.S.C. 154(b) by 240 days.

(21) Appl. No.: 17/488,110

(22) Filed: Sep. 28, 2021

(65) Prior Publication Data

US 2023/0098717 A1 Mar. 30, 2023

(51) Int. Cl.
*A63B 69/36* (2006.01)
*A63B 60/46* (2015.01)

(52) U.S. Cl.
CPC ..... *A63B 60/46* (2015.10); *A63B 69/3632* (2013.01); *A63B 2060/464* (2015.10); *A63B 2214/00* (2020.08)

(58) Field of Classification Search
CPC ..... A63B 60/46; A63B 69/3632; A63B 2060/464; A63B 2214/00
USPC ..... 473/201–206, 219, 223, 298, 299, 473/300–303, 523, 538, 568, 549, 461, 473/453, 551
See application file for complete search history.

(56) References Cited

U.S. PATENT DOCUMENTS 5,322,289 A * 6/1994 Abrams ..... A63B 69/3632 473/202
5,348,503 A 9/1994 Swissheim
5,398,930 A 3/1995 Gibson
5,419,031 A 5/1995 McLendon
5,419,563 A * 5/1995 Abrams ..... A63B 69/3632 473/202
5,439,217 A * 8/1995 Ganger, Sr. ..... A63B 69/3635 473/202
5,681,993 A * 10/1997 Heitman ..... A61B 5/225 473/202
5,803,828 A 9/1998 Huang
5,897,440 A 4/1999 Bae
5,964,670 A 10/1999 Cheng
6,419,601 B1 7/2002 Kenner
6,482,105 B1 11/2002 Lin
6,656,054 B2 12/2003 Ulrich
6,666,777 B1 12/2003 Lamkin
6,923,727 B1 8/2005 Jacobs
7,008,582 B2 3/2006 Chen
7,022,025 B1 * 4/2006 Cascerceri ..... A63B 53/14 473/549
7,175,538 B2 2/2007 Miller
7,189,168 B2 3/2007 Lin
7,294,063 B2 11/2007 Jacobs
7,435,186 B1 10/2008 Miller
7,458,903 B2 12/2008 Wang
7,607,990 B1 10/2009 Blane
7,637,821 B2 12/2009 Johnson
7,749,094 B2 7/2010 Chen
7,794,332 B2 9/2010 Johnson
7,798,912 B2 9/2010 Kou
7,862,446 B2 1/2011 Huang
(Continued)

*Primary Examiner* — Nini F Legesse
(74) *Attorney, Agent, or Firm* — Rodney F. Brown

(57) ABSTRACT

A force sensor is provided for mounting on an outside lateral surface of a golf club grip to alert a user when an excessive manual grasping force is applied to the grip during a golf swing.

20 Claims, 4 Drawing Sheets

(56) References Cited

U.S. PATENT DOCUMENTS

| | | | |
|---|---|---|---|
| 7,896,762 | B2 | 3/2011 | Schroeder |
| 7,963,857 | B1 | 6/2011 | Kachlik |
| 8,062,147 | B2 | 11/2011 | Johnson |
| 8,092,317 | B2 | 1/2012 | Johnson |
| 8,123,627 | B2 | 2/2012 | Huang |
| 8,360,898 | B2 | 1/2013 | Huang |
| 8,518,505 | B2 | 8/2013 | Huang |
| 8,545,339 | B1 | 10/2013 | Edwards |
| 8,641,552 | B2 | 2/2014 | Lu |
| 8,641,553 | B2 | 2/2014 | Gill |
| 9,661,833 | B2 | 5/2017 | Huang |
| 10,052,538 | B2 | 8/2018 | Davis |
| 10,130,858 | B2 | 11/2018 | Lamkin |
| 10,293,230 | B1 | 5/2019 | Davis |
| 10,556,163 | B2 | 2/2020 | Kim |
| 10,632,356 | B2 | 4/2020 | Davis |
| 10,925,271 | B2 | 2/2021 | Huang |

* cited by examiner

FORCE SENSOR FOR ALERTING GOLFER WHEN CLUB HELD TOO TIGHTLY

FIELD OF THE INVENTION

The present invention relates generally to the sport of golf and more particularly to devices and methods used to improve a golf swing.

BACKGROUND

Golf clubs may be categorized as woods, irons, wedges or putters, wherein the term "woods" as used herein includes drivers, fairway metals, and hybrids. All of these golf clubs share common elements, namely, an elongated shaft, a clubhead extending from the distal end of the shaft, and a grip enclosing the proximal end of the shaft. Golf club shafts are typically fabricated from metal, graphite or a combination thereof and have a hollow generally cylindrical construction with a slight taper as the shaft extends distally from the grip to the clubhead. The clubheads of irons have a relatively sleek configuration, whereas the clubheads of woods have a bulbous configuration. Nevertheless, all clubheads have a relatively planar front face, i.e., the club face, which is the ball striking surface of the golf club.

The loft of a golf club is the angle that the club face diverges from true vertical. Each iron in a set of golf clubs has a distinctive loft relative to the other irons in the set and each wood likewise has a distinctive loft relative to the other woods in the set. Most of the irons and woods in a set of golf clubs are assigned numbers corresponding to their specific degree of loft which enables the golfer to readily differentiate each of the irons in the golfer's set of clubs from the other irons in the set and to differentiate each of the woods in the golfer's set of clubs from the other woods in the set. The most common irons are numbered 2-9. The most common woods are numbered 1-7 although a 1-wood is usually called a driver rather than a 1-wood. It is noted that although the same number can be used to identify a particular iron and a particular wood within a given set of clubs, the iron and wood assigned this same number do not necessarily have the same degree of loft. For example, a 3-iron and a 3-wood within the same set of clubs typically have different degrees of loft. Furthermore, there is no standard used for all sets of golf clubs that uniquely associates a specific club number with a specific degree of loft. Thus, for example, a 3-iron in one set of golf clubs may have a different degree of loft than a 3-iron in another set of golf clubs.

Notwithstanding the foregoing, there is a direct relation between the degree of loft of an iron and the unique number assigned to that iron from among all the irons within a given set of golf clubs. Thus, greater the number of an iron within the same set of golf clubs, the greater the degree of loft of the iron relative to the other lower-numbered irons within the set. There is similarly a direct relation between the degree of loft of a wood and the unique number assigned to that wood from among all the woods within a given set of golf clubs. Thus, the greater the number of a wood within the same set of golf clubs, the greater the degree of loft of the wood relative to the other lower-numbered woods within the same set. Therefore, a 3-iron has a greater degree of loft than a 2-iron, a 4-iron has a greater degree of loft than a 3-iron and so on within the same set of golf clubs. Similarly, a 3-wood has a greater degree of loft than a 2-wood, a 4-wood has a greater degree of loft than a 3-wood and so on within the same set of golf clubs. Furthermore, as a general rule with respect to the numbering of irons, numbers 2-4 are typically associated with long irons, numbers 5-7 with mid irons and numbers 8-9 with short irons.

The grip is the part of the golf club on the proximal end of the shaft that the golfer securely grasps with both hands when holding the club during a golf shot. All grips, with the sole exception of those for putters, must have a cylindrical outside lateral surface and correspondingly a circular cross section. The grips of putters are permitted, but not required, to have an irregular non-cylindrical outside lateral surface. The outside lateral surface of a cylindrical grip may be characterized as having four identical quadrants: 1) a lead quadrant that faces in the direction of the shot when the golfer is addressing the ball; 2) a trail quadrant that is opposite the lead quadrant and faces away from the shot; 3) a rear quadrant that faces the golfer when the golfer addressing the ball; and 4) a front quadrant that is opposite the rear quadrant and faces away from the golfer. A typical golfer holds the club so that substantially the entirety of the inside surfaces of both hands are in direct contact with the outside lateral surface of the grip. The palms and fingers of both hands are typically wrapped around the grip and clenched into fists so that their inside surfaces engage the lead, trail and rear quadrants of the grip surface. In contrast, the thumbs are typically extended downward toward the clubhead with the thumb of the lead hand tucked under the palm of the trail hand. The inside surfaces of the thumbs engage the front quadrant of the grip surface.

Grips are fabricated from any number of materials alone or in combination. Rubber or like synthetic materials such as plastics and synthetic elastomers including silicone elastomers are the most common materials used to fabricate grips. Grips fabricated from these types of materials are usually configured as a one-piece sleeve with an inside diameter that approximates the outside diameter of the proximal end of the shaft. The grip is fitted over the proximal end of the shaft to fully cover it and the tight fit of the grip on the shaft securely holds the grip in place. A variation of the sleeve grip is one in which a cord made from a material such as a textile is embedded in the outside lateral surface of the grip to enhance the grip's all-weather capabilities. Grips are alternatively, but less commonly, fabricated from a long narrow band of leather or synthetic leather that is tightly wound around the proximal end of the shaft to fully cover it. The outside lateral surface of the grip, regardless of its material of fabrication, is typically textured with slits, channels, pin holes, ridges or the like to improve the golfer's hold on the club. Grips are also categorized by their size, wherein the cross-sectional diameter of a grip is the measure of its size. As a rule, the size of the grip is directly related to the size of the golfer's hands so that golfers with larger hands require larger sized grips. In some instances the golfer may employ different size grips on different clubs within a given set of golf clubs. For example, a golfer may employ a larger size grip on a putter than on the other clubs in the golfer's set.

Proper club selection is an important factor in the success of a golf shot and is based on several considerations, including the part of the course where the shot is taken, e.g, tee, fairway, rough, sand trap or green, the lie of the ball and the distance to the pin from where the ball lies. As a rule, a driver is only used on the tee of a par-4 or par-5 hole. Once off the tee, whether in the fairway or rough, but still relatively far from the pin, e.g., 200 yards or more, the golfer commonly uses a fairway metal, hybrid or long iron. As the golfer moves closer to the pin, e.g., within 200 yards to 140 yards, the golfer commonly switches to a mid iron and moving still closer to the pin, e.g., within 140 yards or less, the golfer commonly switches to a short iron or wedge.

Another important factor is swing length which is defined as the overall distance that the clubhead travels during a golf swing and is measured from the top of the back swing to the end of the follow through. Although there may be some variation in maximum swing length among individual golfers because of each golfer's unique build, physical capabilities and/or personal preferences, as a rule a golfer maximizes his or her swing length, i.e., takes a full swing, when hitting a wood or long iron 200 yards away or more from the pin. A golfer may also use the maximum swing length and take a full swing when hitting a mid iron, short iron or wedge. However, it is alternatively common for a golfer to shorten the swing when hitting these clubs, particularly when hitting a short iron or wedge. Shortening the swing means to reduce the swing length from the maximum swing length by taking less than a full swing, i.e., by taking a shortened swing. Using a putter on the green or apron of the green is a special case where the golfer takes an even shorter swing termed a putting stroke.

Regardless of club selection and swing length, it is critical that the golfer's handhold is adequately secured on the grip for the duration of the swing. Thus, the degree of force that the golfer uses to grasp the club with the hands during the swing, i.e., how tightly the golfer holds the club, is an important parameter of an ideal golf swing. As a general rule, a golfer desirably applies the greatest manual grasping force to a club, i.e., has the tightest hold on the club, when the golfer uses his or her maximum swing length and takes a full swing because the centrifugal and impact forces on the club are generally highest in full-swing mode. The golfer desirably decreases the manual grasping force applied to the club and loosens the hold on the club when the golfer reduces the swing length from the maximum swing length and takes a shortened, less than full swing. The golfer desirably decreases the manual grasping force still further when using the shortened putting stroke.

If the golfer fails to apply a sufficient manual grasping force to the club with the hands and has a weak handhold on the grip, swing performance is detrimentally affected because the club face may rotate prior to or upon impact with the ball. In extreme cases the club may even fly out of the golfer's hands altogether during the swing. Notwithstanding the above, if the golfer applies too great a force to the club with the hands, thereby overly tightening the handhold on the grip, swing performance can also be detrimentally affected. It is usually intuitively obvious to the golfer when the handhold on the grip is not tight enough, because the golfer can feel a sub-optimal impact force between the ball and the club face and/or can feel the club rotating in the golfer's hands during the swing. However, it is oftentimes much more difficult for the golfer to detect an overly tight handhold on the grip.

As such, the present invention recognizes a need for a device and method that alerts a golfer when the golfer is applying an excessive manual grasping force to the club during the golf swing. Accordingly, it is an object of the present invention to provide a force sensor that detects and alerts a golfer when the golfer applies too great a manual grasping force to the golf club, i.e., has an overly tight handhold on the grip. It is another object of the present invention to provide such a force sensor that alerts the golfer by means of real-time proprioceptive feedback. It is another object of the present invention to provide such a force sensor that is elegant in its simplicity, being low-cost, disposable and simply-constructed, while forgoing any electronics and instead operating in a non-electrical, strictly manual manner.

These objects and others are accomplished in accordance with the invention described hereafter.

SUMMARY OF THE INVENTION

The present invention may be characterized as a force sensor mountable on an outside lateral surface of a golf club grip. The force sensor includes a base member and an overlying member positioned atop the base member. The base member has a substratum with a substratum inner face and a substratum outer face and has a projection on said substratum outer face having a projection height. The overlying member has an overlying member inner face, an overlying member outer face and a channel extending from said overlying member inner face to said overlying member outer face that is configured to receive said projection in a channel interior. The base member has a relatively high resistance to elastic compressive deformation, while the overlying member has a relatively low resistance to elastic compressive deformation when a manual grasping force is applied to them during the golf swing. The overlying member has an overlying member thickness with an ambient thickness value greater than the projection height when the overlying member is in an ambient state. The overlying member thickness is reduced to a compressed thickness value less than the projection height when a manual grasping force exceeding a maximum permissible force value is applied to the overlying member during the golf swing which extends the projection out from the channel interior beyond the overlying member outer face.

Alternate embodiments of the above-described force sensor may include additional features as follows. In accordance with one alternate embodiment, the projection has a conical configuration and/or the channel has a cylindrical configuration. In accordance with another, the base member has a base member outer perimeter defining a base member footprint, the overlying member has an overlying member outer perimeter defining an overlying member footprint and the overlying member footprint is greater than the base member footprint such that the overlying member fully covers and extends beyond the base member outer perimeter. In accordance with another, the force member has a force sensor surface area and the force sensor is dimensioned so that the force sensor surface area is substantially less than a lateral surface area of a golf club grip the force sensor is mountable on. In accordance with yet another alternate embodiment, the relatively low resistance to elastic compressive deformation enables the overlying member to elastically deform to the compressed thickness value that is 75% or less of the ambient thickness value when a manual grasping force at or exceeding the maximum permissible force value is applied to the overlying member during the golf swing. In accordance with still other alternate embodiments, an adhesive is provided on the overlying member inner face that enables adherence of the base member outer face and overlying member inner face to one another, the overlying member has a Shore A durometer in a range between about 10 and about 30, and/or the base member has a Shore A durometer in a range between about 60 and about 90.

The present invention may be alternately characterized as a force sensor mountable on an outside lateral surface of a golf club grip and having a base member and an overlying member that are substantially similar to those recited above except that the base member has at least three projections mounted thereon and the overlying member correspondingly has at least three channels formed therethrough. In accordance with one alternate embodiment, the first, second and third projections are aligned in series forming a single linear longitudinal projection column and are spaced a projection spacing distance apart from one another in the projection column. In accordance with another, the first, second and third channels are aligned in series forming a single linear longitudinal channel column and are spaced a channel spacing distance corresponding to the projection spacing distance apart from one another in the channel column.

The present invention may be alternately be characterized as a swing training method having a plurality of steps as follows. A force sensor is mounted on a grip outside lateral surface of a golf club. The force sensor includes a base member having a relatively high resistance to elastic compressive deformation when a manual grasping force is applied to the base member during a golf swing and an overlying member having a relatively low resistance to elastic compressive deformation when the manual grasping force is applied to the overlying member during the golf swing. The base member includes a substratum with a substratum inner face and a substratum outer face and a projection on the substratum outer face with a projection height. The overlying member is positioned atop the base member on the grip outside lateral surface and includes an overlying member inner face, an overlying member outer face and a channel extending from the overlying member inner face to the overlying member outer face that is configured to receive the projection in a channel interior. The overlying member thickness has an ambient thickness value greater than the projection height when the overlying member is in an ambient state.

The golf swing is performed while holding the golf club with a user's hand in contact with the force sensor, thereby applying the manual grasping force to the overlying member. The overlying member elastically deforms to reduce the overlying member thickness to a compressed thickness value less than the projection height when the manual grasping force applied to the overlying member during the golf swing exceeds a maximum permissible force value, thereby enabling the projection to extend out from the channel interior beyond the overlying member outer face and engage the user's hand.

In accordance with an alternate embodiment, the golf club is a first golf club, the grip outside lateral surface is a first grip outside lateral surface, the force sensor is a first force sensor, the base member is a first base member, the substratum is a first substratum, the projection is a first projection, the height of the projection is a first projection height and the overlying member is a first overlying member. A second force sensor is mounted on a second grip outside lateral surface of a second golf club. The second force sensor includes a second base member having the same relatively high resistance to elastic compressive deformation club as the first base member and a second overlying member substantially identical to the first overlying member. The second base member includes a second substratum substantially identical to the first substratum and a second projection having a second projection height different than the first projection height. The second overlying member is positioned atop the second base member on the second grip outside lateral surface and has a second channel configured to receive the second projection in a second channel interior. The second overlying member thickness has an ambient thickness value greater than the second projection height when the second overlying member is in an ambient state.

A golf swing is performed while holding the second golf club with the user's hand in contact with the second force sensor, thereby applying a manual grasping force to the second overlying member. The second overlying member is elastically deformed to reduce the overlying member thickness to a second compressed thickness value less than the second projection height when the manual grasping force applied to the second overlying member during the golf swing exceeds a second maximum permissible force value, thereby enabling the second projection to extend out from the second channel interior beyond the second overlying member outer face and engage the user's hand.

In accordance with another alternate embodiment, the first projection height is shorter than the second projection height. The golf swing the user performs while holding the first golf club is a full swing having the user's maximum swing length. The golf swing the user performs while holding the second golf club is a shortened less than full swing having a shorter swing length that is less than the user's maximum swing length.

The invention will be further understood from the accompanying drawings and description.

BRIEF DESCRIPTION OF THE DRAWINGS

The below-listed drawing figures illustrate one or more embodiments of the present invention by way of example and not by way of limitation. Common reference characters are used among the different drawing figures to indicate the same structural elements.

DETAILED DESCRIPTION OF THE INVENTION

Figure 1:
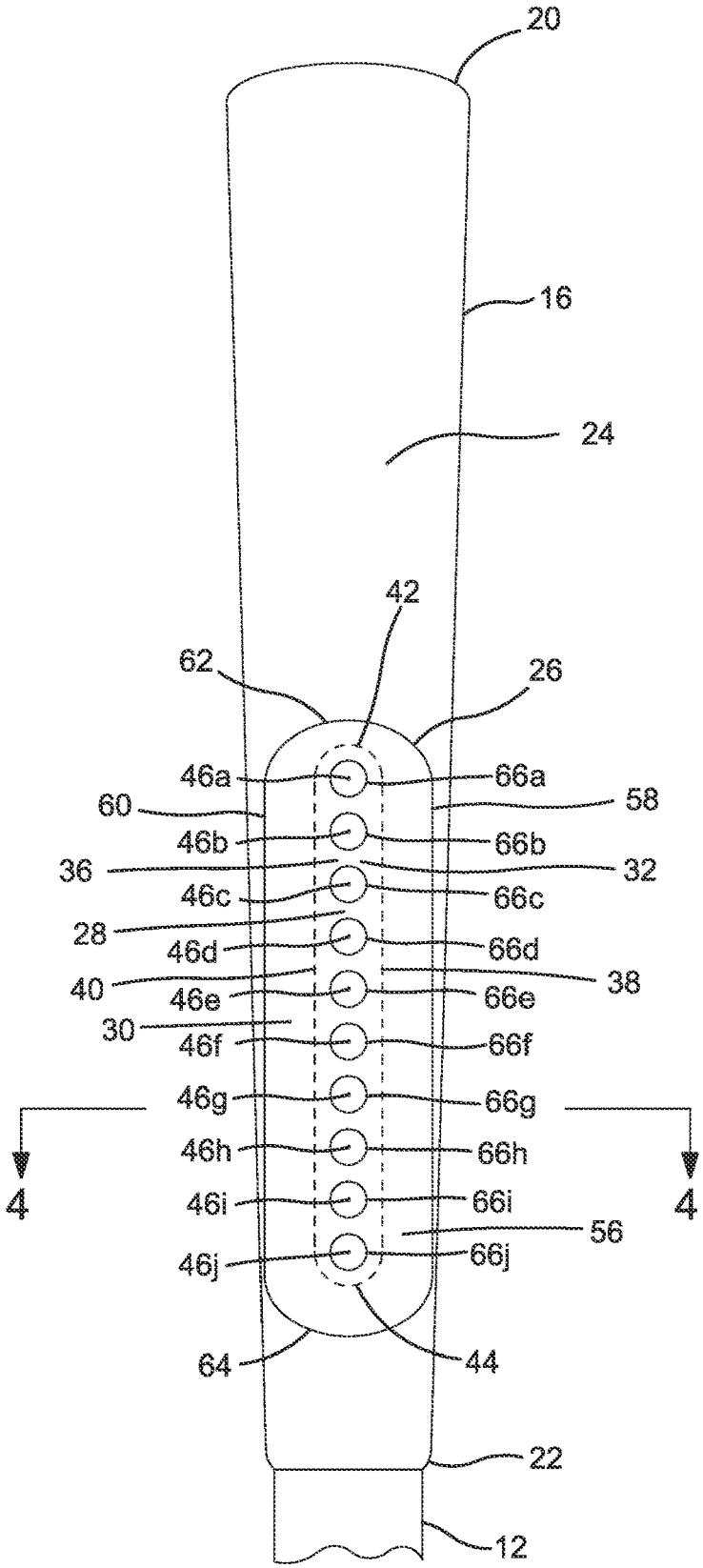
FIG. 1 is a front elevation view of a golf club grip with a force sensor mounted thereon, wherein the perimeter of the base member is shown in phantom.
Figure 2:
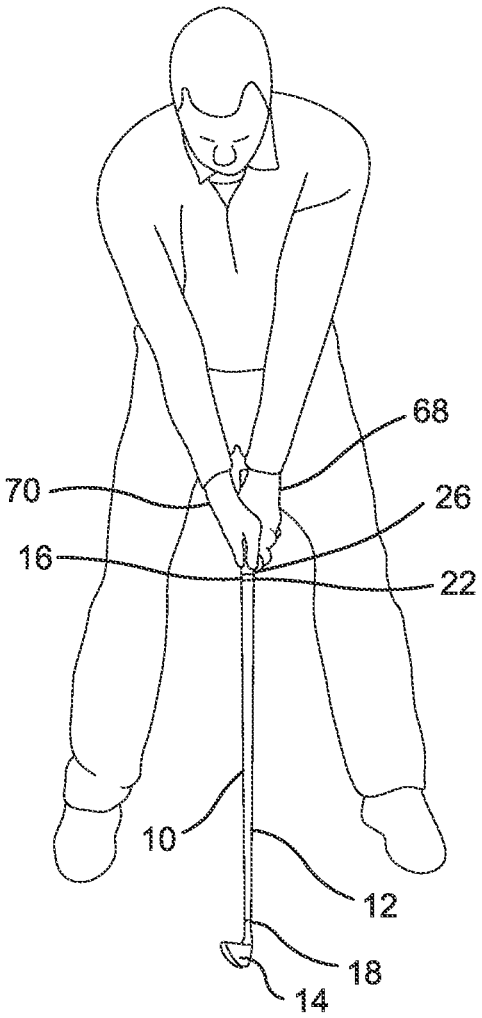
FIG. 2 is a front view of a user holding a golf club with a force sensor mounted on the grip, wherein the user is in the address position of a golf shot.

Referring to FIGS. 1 and 2, a conventional golf club, namely a long iron, is shown and generally designated 10. The golf club 10 includes a shaft 12, a clubhead 14 and a grip 16. The shaft 12 has a distal end 18 and a proximal end 20. The clubhead 14 is mounted on the distal end 18 and the grip 16 is mounted on the proximal end 20. The grip 16 likewise has a distal end 22 and a proximal end. The proximal end of the grip 16 coincides with the proximal end 20 of the shaft 12. Therefore, both proximal ends are designated herein by the same reference number 20. The grip 16 has an outside lateral surface 24 that extends the entire length of the grip 16 from the proximal to distal grip ends 20, 22 A typical grip has a grip length of about 10 inches and an average grip radius of about 0.5 inches. The total area of the outside lateral surface 24 is termed the grip lateral surface area and a grip having the above dimensions has a grip lateral surface area of about 31 sq. in.

Figure 3:
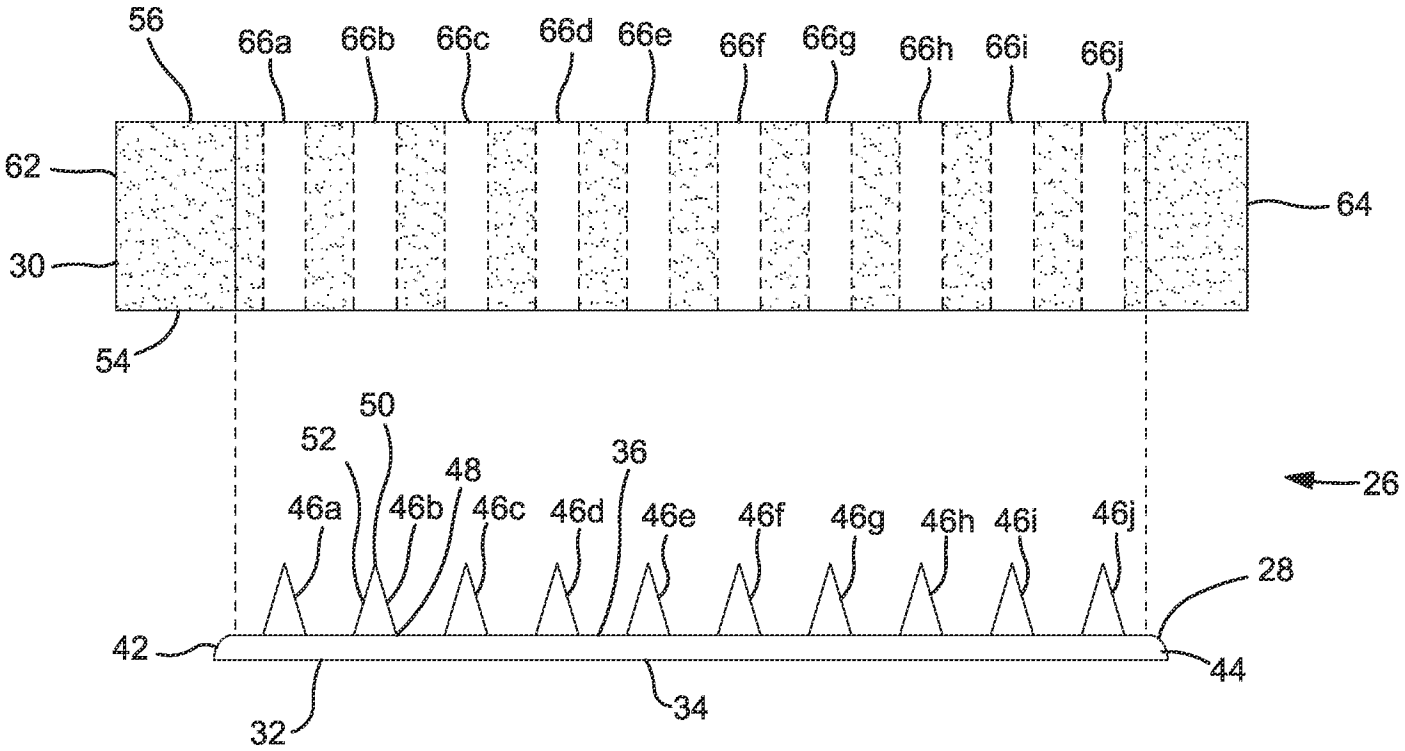
FIG. 3 is an exploded elevation view of the force sensor of FIG. 1, wherein the channels through the overlying member are shown in phantom.

FIGS. 1 and 2 show an embodiment of a force sensor 26 mounted on the outside lateral surface 24 of the grip 16. With added reference to FIGS. 3-5, the force sensor 26 comprises a base member 28 and an overlying member 30. The base member 28 includes a substratum 32 which is a relatively rigid, narrow, elongated strip of material having an inner face 34 on one side of the substratum 32 and an outer face 36 on the opposite side. The relative terms inner and outer are used herein with reference to the common longitudinal axis of the shaft 12 and grip 16 when the force sensor 26 is mounted on the grip 16 in a manner described below. The substratum inner face 34 is more proximal to the common longitudinal axis and the substratum outer face 36 is more distal from the common longitudinal axis. Conversely, when a user, in this case a golfer, is holding the golf club 10 during a golf shot with the force sensor 26 mounted on the grip 16, the substratum inner face 34 is more distal from the hands of the user and the substratum outer face 36 is more proximal to the user's hands. The substratum inner face 34 preferably has an arcuate configuration with a radius of curvature substantially equal to that of the grip outside lateral surface 24 so that the relatively rigid substratum inner face 34 conforms to the contour of the outside lateral surface 24 and fits snugly against it when the force sensor 26 is mounted thereon.

The substratum inner and outer faces 34, 36 are laterally-bounded by parallel sides 38, 40 and are end-bounded by proximal and distal ends 42, 44 which define the planar outside perimeter of the substratum 32. The substratum sides and ends 38, 40, 42, 44 are all preferably rounded off to minimize sharp edges and corners. It is apparent that the sides and ends of the base member 28 are one and the same as the substratum sides and ends 38, 40, 42, 44, respectively. Accordingly, the planar outside perimeter of the base member 28 and the substratum outside perimeter are likewise one and the same and the dimensions of this outside perimeter are preferably correlated with the dimensions of a typical grip 16. An exemplary base member length, i.e., distance between ends 42, 44, is about 4 inches and an exemplary base member width, i.e., distance between sides 38, 40, is about ½ inch.

The base member 28 further includes a plurality of projections 46 positioned on the substratum outer face 36 and extending in a direction away from the substratum inner face 34. The present embodiment of the base member 28 has ten projections 46*a*, 46*b*, 46*c*, 46*d*, 46*e*, 46*f*, 46*g*, 46*h*, 46*i*, 46*j* extending from the substratum outer face 36. The projections 46 are preferably aligned in series on the substratum outer face 36 forming a single linear longitudinal column aligned with the longitudinal axis of the substratum 32 which is one and the same as the base member longitudinal axis. The projection column extends substantially the entire length of the substratum outer face 36. The projections 46 are longitudinally spaced apart from one another, preferably equidistantly. In the present embodiment, all of the projections 46 are identically configured as right circular cones resembling spikes. However, alternately configured projections are within the scope of the present invention. Regardless of the configuration, each projection 46 has a projection base 48 at one end of the projection 46 that is integral with the substratum outer face 36, a projection apex 50 at the opposite end of the projection 46 and a projection side 52 extending from the base 48 to the apex 50. Each projection 46 has a projection height defined as the linear distance from the base 48 to the apex 50. Where the projection 46 is a right circular cone as in the present embodiment, the projection height is the length of the cone axis and the projection side 52 is a curved surface that tapers to the projection apex 50, which is a fine point forming the tip of the cone.

The substratum 32 and projections 46 are preferably integrally formed with one another such that the base member 28 is a unitary integral structure. A preferred material of construction for the base member 28 is a readily-available, low-cost, disposable, rigid, hard plastic such as polypropylene and a preferred means of construction is injection molding. As such, the rigid, hard base member 28 is relatively firm and highly resistant to elastic compressive deformation so that it does not substantially indent or compress when subjected to the manual grasping force of a user's hands during a golf swing.

The overlying member 30, like the substratum 32, has an elongate configuration with an inner face 54 and an outer face 56 that are laterally-bounded by parallel sides 58, 60 and are end-bounded by proximal and distal ends 62, 64 which define the planar outside perimeter of the overlying member 30. The overlying member ends 62, 64 are preferably rounded off. The overlying member length and width are each greater than the respective base member length and width. Accordingly, the overlying member outside perimeter is larger than that of the base member 28 and the overlying member 30 correspondingly has a larger area and footprint than the base member 28.

The overlying member 30 is positioned atop the base member 28 with their longitudinal axes parallely aligned with one another so that the overlying member 30 member overlaps the base member 28 and covers the base member outside perimeter in its entirety. With the overlying member 30 and base member 28 so positioned, portions of the overlying member inner face 54 that are interior to the overlying member outside perimeter engage the relatively planar portions of the substratum outer face 36 that are not occupied by the projections 46. The remainder of the overlying member inner face 54 extends beyond the base member outside perimeter to the overlying member outside perimeter.

The base member 28 and overlying member 30 are attached to one another by any conventional attachment means that renders the overlying member inner face 54 and substratum outer face 36 in fixed engagement with one another during use of the force sensor 26. A preferred attachment means is an adhesive that adheres the base and overlying members 28, 30 to one another. The adhesive is preferably applied to the entirety of the overlying member inner face 54, but not any other surfaces of the force sensor 26. A paper backing (not shown) may be placed over the adhesive on the remainder of the overlying member inner face 54 that extends beyond the base member outside perimeter to prevent the adhesive from prematurely adhering to a surface before the user desires to mount the force sensor 26 on the grip outside lateral surface 24 in a manner described hereafter. When the user desires to mount the force sensor 26, the user simply peels away the paper backing from the overlying member inner face 54 to expose the adhesive.

It is apparent that the sides and ends of the force sensor 26 are one and the same as the overlying member sides and ends 58, 60, 62, 64, respectively. Accordingly, the planar outside perimeter of the force sensor 26 and the overlying member outside perimeter are likewise one and the same and the dimensions of this outside perimeter are preferably correlated with the dimensions of a typical grip 16 as well as the dimensions of the base member 28. An exemplary force sensor length, i.e., distance between ends 62, 64, is about 5 inches and an exemplary force sensor width, i.e., distance between sides 58, 60, is about 1 inch. The base member, overlying member and force sensor dimensions recited herein are offered by way of example rather than limitation. Base members, overlying members and force sensors having different dimensions than those recited above are within the scope of the present invention so long as the overlying member has a larger footprint than the base member.

The overlying member 30 has a thickness that is quantified as the distance between the overlying member inner face 54 and overlying member outer face 56. The overlying member 30 has a plurality of channels 66 formed therein, each of which extends through the entirety of the overlying member 30 from its inner to outer faces 54, 56. Accordingly, the thickness of the overlying member 30 and the distance each channel 66 extends through the overlying member 30 are one and the same. The number and placement of the channels 66 preferably correspond identically to those of the projections 46. Therefore, the overlying member 30 of the present embodiment has ten channels 66*a*, 66*b*, 66*c*, 66*d*, 66*e*, 66*f*, 66*g*, 66*h*, 66*i*, 66*j* passing through the overlying member 30. The channels 66 are preferably serially aligned on the overlying member 30 in a single linear longitudinal column aligned with the overlying member longitudinal axis. The channel column extends substantially the entire length of the overlying member 30 and the channels 66 have the same longitudinal spacing apart from one another as the projections 46 on the substratum outer face 36. Each channel 66 preferably has the same cylindrical configuration with circular openings in the opposing overlying member inner and outer faces 54, 56. The channel openings in the overlying member inner face 54 are each sized and configured to receive one of the projections 46 into the interior of the channel 66. As such, each channel 66 preferably has about the same diameter as each projection base 48, e.g, about 4 mm.

The overlying member 30 is a unitary integral structure preferably constructed from a readily-available, low-cost, disposable material such as a sheet of soft, pliable elastic foam. A preferred material having the recited properties is a synthetic rubber such as neoprene. The overlying member 30 is preferably readily elastically compressively deformable when subjected to the manual grasping force of a user's hands during a golf swing. As such, the overlying member 30 preferably has a relatively low density per cubic foot and a Shore A durometer in a range between about 10 and about 30, and more preferably in a range between about 15 and about 25. In contrast as noted above, the base member 28 does not elastically compressively deform when subjected to the manual grasping force of a user's hands during a golf swing. As such, the base member 28 has a density and durometer substantially greater than those of the overlying member 30. In particular, the base member 28 preferably has a relatively high density per cubic foot and a Shore A durometer in a range between about 60 and about 90, and more preferably in a range between about 70 and about 80. A typical golf club grip is harder, i.e., firmer, than the overlying member 30, while softer, i.e., less firm, than the base member 28. As such, the base member 28 has a density and durometer greater than those of the grip 16, while the overlying member 30 has a density and durometer less than those of the grip 16.

Figure 4:
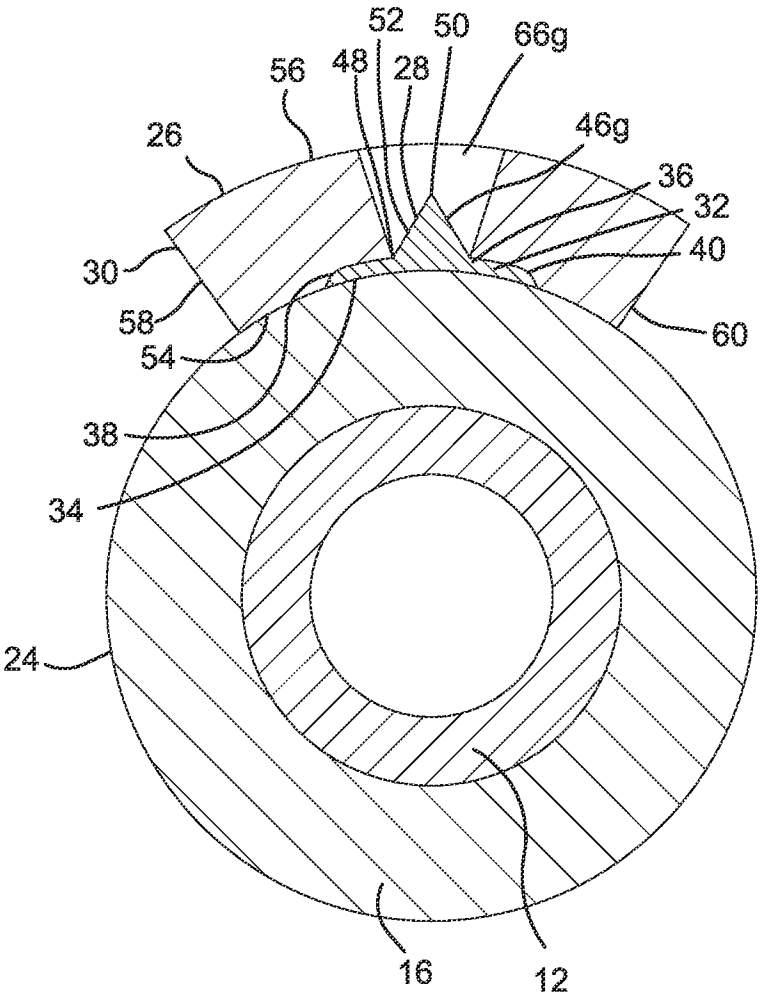
FIG. 4 is a sectional view of the force sensor of FIG. 1 taken along line 4-4, wherein the force sensor is in an ambient state.

FIG. 4 shows the force sensor 26 when it is not subjected to any external forces (apart from gravity), such as the manual grasping force of a user's hands during a golf swing, that could elastically compressively deform the overlying member 30. As such, the overlying member 30 shown in FIG. 4 is not compressively deformed and is characterized herein as being in an ambient state. The thickness of the overlying member 30 in the ambient state, termed the ambient thickness value, is greater than the height of the projections 46. If the overlying member 30 has a preferred ambient thickness value of about 3.0 mm, the corresponding preferred height of the associated projection 46 is in a range between about 1.0 mm and about 2.2 mm. Overlying members having different ambient thickness values and projections having different heights than those recited above are within the scope of the present invention so long as the overlying member has an ambient thickness value greater than the height of the projections.

Swing Training Methods Using the Force Sensor

FIG. 2. shows a user holding the golf club 10 in the address position at the beginning of a golf shot. The lead hand 68 and trail hand 70 are positioned one after the other in series with the lead hand 68 positioned at the grip proximal end 20 and the trail hand 70 positioned immediately below, but still in engagement with the lead hand 68. Thus, the trail hand 70 is more distally positioned than the lead hand 68. The fingers and palms of both hands 68, 70 encircle the grip 16 and the thumbs are fully extended in a generally vertical downward direction perpendicular to the orientation of the fingers toward the clubhead 14. The thumbs are generally collinear with one another and in alignment with the common longitudinal axis of the shaft 12 and grip 16. The thumb of the lead hand 68 is tucked under the portion of the palm of the trail hand 70 that is immediately adjacent to the thumb and wrist of the trail hand 70. The relative lengths of the grip 16 and user's hands are such that the grip distal end 22 extends another inch or two in the distal direction below the tip of the trail hand thumb.

FIG. 1 shows the force sensor 26 mounted on the grip outside lateral surface 24. Mounting is effected by positioning the force sensor 26 at a desired location on the grip outside lateral surface 24 with the force sensor longitudinal axis parallely aligned with the grip and shaft longitudinal axes and attaching the force sensor 26 to the grip outside lateral surface 24, preferably by means of the above-described adhesive on the overlying member inner face 54. It is apparent that when the force sensor 26 is mounted on the outside lateral surface 24, it only covers a fraction of the exemplary grip lateral surface area. Thus, the surface area of the force sensor is substantially less than the grip lateral surface area. As an example, a force sensor having the exemplary dimensions recited above has a force sensor surface area of about 5 square inches while an exemplary grip lateral surface area recited above is about 31 square inches which is only about 16% coverage. In any case, the force sensor surface area is preferably less than about 50% of the grip lateral surface area, more preferably less than about 30% and still more preferably less than about 20% of the grip lateral surface area.

When the force sensor 26 is mounted on the grip outside lateral surface 24, the force sensor 26 intervenes between the outside lateral surface 24 and the parts of the user's hands that are positioned over the force sensor 26 when holding the club 10. As a result these parts of the hands do not contact the outside lateral surface 24, but are instead in continuous contact with the overlying member outer face 56. In a preferred embodiment, the force sensor 26 is mounted in a position on the grip outside lateral surface 24 that is immediately beneath where the user would place the thumbs as shown in FIG. 2. Accordingly, when the thumbs are positioned over the front quadrant of the outside lateral surface 24, as is typical, the force sensor 26 is correspondingly mounted on the front quadrant of the outside lateral surface 24 with the force sensor distal end 64 positioned an inch or two above the grip distal end 22. In this mounting position, the force sensor 26 extends roughly half the length of the grip 16 and wraps around about ¼ to about ⅓ the circumference of the grip 16. The inside surfaces of both thumbs and the parts of the palm immediately adjacent thereto are in continuous contact with the overlying member outer face 56 throughout the shot while the fingers and remainder of the palms are in contact with the grip outer lateral surface 24. It is alternately within the scope of the present invention to mount the force sensor 26 at a different position on the outside lateral surface 24 rather than the front quadrant should the user desire to position the thumbs on an alternate quadrant of the outside lateral surface 24 when holding the club 10. It is still further within the scope of the present invention to mount the force sensor 26 at a position on the outside lateral surface 24 that lies under some part of the user's hands other than the thumbs should the user desire to monitor the manual grasping force of the user's fingers or palms on the club.

The function of the force sensor 26 is enabled by the positive differential between the overlying member ambient thickness value and the projection height. Because of this differential, the projection apexes 50 are hidden beneath the overlying member outer face 56 within the interiors of their respective channels 66 when the overlying member 30 is in the ambient state. When the manual force that the user subsequently applies to the force sensor 26 during a golf swing does not exceed a predetermined maximum permissible force value, the ambient thickness value, density and durometer of the overlying member 30 are pre-selected such that the parts of the user's hands contacting the overlying member outer face 56 do not elastically compressively deform the overlying member 30 to a degree sufficient to compress its thickness to a value that is less than the projection height. As a result, the projection apexes 50 remain beneath the overlying member outer face 56 within the channel interiors throughout the swing and the user does not feel the projection apexes 50. In sum, when the user applies a proper degree of manual force to the club 10 during the swing, the user is essentially unaware of the presence of the force sensor 26 and performs the golf swing as if holding the grip 16 without the force sensor 26 mounted thereon.

Figure 5:
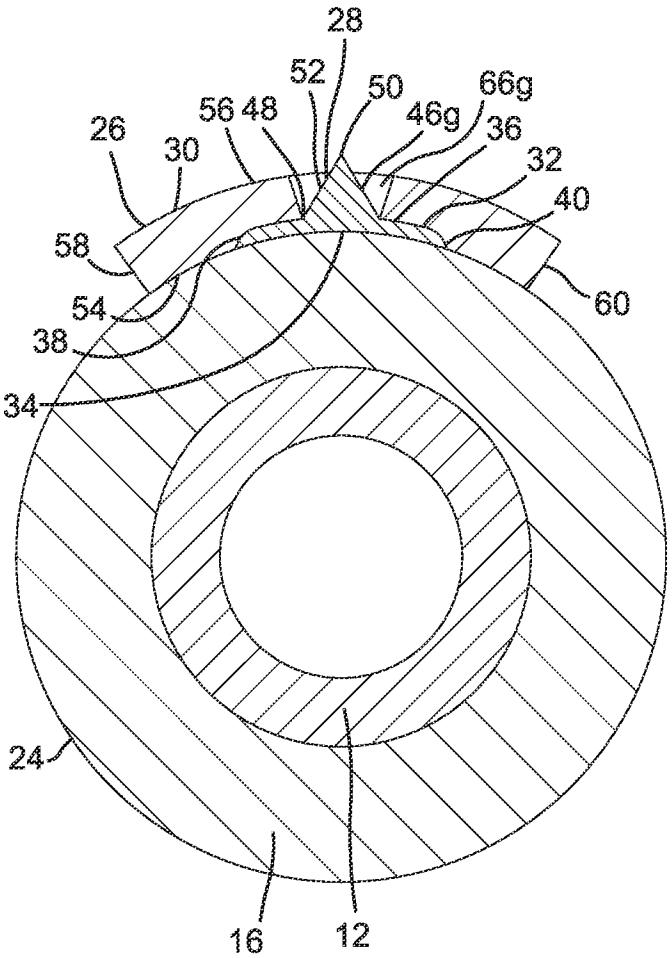
FIG. 5 is the same sectional view of the force sensor shown in FIG. 4, but with the force sensor in a compressed state.

In contrast, FIG. 5 shows that when the manual force the user applies to the force sensor 26 during the golf swing exceeds the predetermined maximum permissible force value, the ambient thickness value, density and durometer of the overlying member 30 are pre-selected such that the user's hands (omitted from FIG. 5 for clarity) elastically compressively deform the overlying member 30 to a value termed the compressed thickness value that is less than the projection height. When the overlying member 30 is deformed to this degree, it is characterized herein as being in a compressed state. The projections 68 have a high density and durometer making them much harder and much more resistant to elastic compressive deformation than the overlying member 30, thereby causing the pointed projection apexes 50 to emerge out from the channel interiors, through the channel openings on the overlying member outer face 56 and extend above the outer face 56 into engagement with the parts of the user's hands positioned over the force sensor 26. The hands instantly proprioceptively sense the projection apexes 50 upon contact, which alerts the user that the handhold on the club 10 is too tight. In response the user can loosen the handhold and apply a manual force to the club 10 that is below the maximum permissible force value. This causes the overlying member 30 to elastically expand and return to a thickness greater than the projection height so that the projection apexes 50 re-submerge into the interiors of the channels 66 and no longer engage the user's hands.

As noted above, the proper level of handhold tightness, i.e., manual grasping force, for a golf swing is inter alia a function of the golfer's variation in swing length from shot to shot. The variability of the golfer's swing length and correspondingly of the optimal level of handhold tightness or manual grasping force for different golf shots is accommodated herein by providing two or more types of force sensors that are distinguished from one another solely by the different projection heights on each type of force sensor, while the overlying members retain the same uniform ambient thickness value, density and durometer. For example, one type of force sensor may be provided that has relatively short projections so it can be used when taking full swings that require a higher manual grasping force, e.g, projections having a height of about 1.0 mm when the ambient thickness value of the overlying member is about 3.0 mm. Another type of force sensor may be provided that has relatively tall projections so it can be used with putters that require a lower manual grasping force, e.g, projections having a height of about 2.2 mm for the same ambient thickness value as above. Yet another type of force sensor may be provided that has projections of intermediate height so it can be used when taking less than full swings that require an intermediate manual grasping force, e.g, projections having a height of about 1.3 mm for the same ambient thickness value as above.

It is apparent from the present example that the ambient thickness value, density and durometer of the overlying member is selected such that the overlying member is capable of being elastically deformed to a compressed thickness value that is substantially less than its ambient thickness value when a manual grasping force at or exceeding the maximum permissible force value is applied to it in order for the associated force sensor to perform effectively for its intended purpose. An overlying member is preferably selected that is capable of being elastically deformed to a compressed thickness value that is about 75% or less of its ambient thickness value when a manual grasping force at or exceeding the maximum permissible force value is applied to it, more preferably about 45% or less of its ambient thickness value, and most preferably about 35% or less of its ambient thickness value.

A user can employ the above-described swing training method while practicing a golf swing at any number of practice locations, e.g., at home or at a practice range. Alternatively, the user can employ the swing training method while actually playing a round of golf on a golf course. If the user only wishes to employ the force sensor while practicing, but not on the golf course, the user can easily remove the force sensor from the grip of the club it is mounted on without damaging club grip and store the force sensor for later use or dispose of it before using the club for a round of golf. The user can re-mount the same previously used force sensor on the grip or mount a new force sensor on the grip for practice or play thereafter.

While the forgoing preferred embodiments of the invention have been described and shown, it is understood that alternatives and modifications, such as those suggested and others, may be made thereto and fall within the scope of the invention. For example, the present embodiment of the force sensor 26 has ten projections 46 and correspondingly ten channels 66. However, this number of projections and channels is disclosed by way of example and not by way of limitation. Force sensors having an alternate number of projections and channels are within the scope of the present invention. The force sensor must have at least one projection and one corresponding channel, but a preferred force sensor has at least two projections and corresponding channels and more preferably has three or more. The advantage of a force sensor with multiple projections is that the projections are capable of engaging multiple points on a user's hands during use of the force sensor.

Although a preferred embodiment has been disclosed above, wherein the projection height is varied for different types of force sensors while maintaining the ambient thickness value, density and durometer of the overlying members constant to accommodate golf shots with different swing lengths, it is readily apparent to one of ordinary skill in the art applying the teaching herein that it is alternatively within the scope of the present invention to vary the ambient thickness value for different types of force sensors while maintaining the density and durometer of the overlying members and projection height constant. It is yet another alternative to vary the density and durometer of the overlying members while maintaining the ambient thickness value and projection height constant. It is a still further alternative to simultaneously vary more than one of the above-recited parameters, i.e., ambient thickness value, overlying member density and durometer and projection height, to accommodate different types of golf clubs.

In the present preferred embodiment, the force sensor is provided to the user in a fully assembled condition. However, it is alternatively within the scope of the present invention to provide the force sensor to the user in a disassembled condition with the base and overlying members separate from one another. The user can readily assemble the force sensor whenever desired applying the teaching herein.

We claim:

1. A force sensor mountable on an outside lateral surface of a golf club grip comprising:

a base member having a substratum with a substratum inner face and a substratum outer face and a projection on said substratum outer face having a projection height, wherein said base member has a relatively high resistance to elastic compressive deformation when a manual grasping force is applied to said base member during a golf swing; and an overlying member positioned atop said base member and having an overlying member inner face, an overlying member outer face and a channel extending from said overlying member inner face to said overlying member outer face and configured to receive said projection in a channel interior, wherein said overlying member has an overlying member thickness with an ambient thickness value greater than said projection height when said overlying member is in an ambient state, and wherein said overlying member has a relatively low resistance to elastic compressive deformation, thereby reducing said overlying member thickness to a compressed thickness value less than said projection height when a manual grasping force exceeding a maximum permissible force value is applied to said overlying member during the golf swing and extending said projection out from said channel interior beyond said overlying member outer face.

2. The force sensor of claim 1, wherein said overlying member inner face has an adhesive thereon enabling adherence of said base member outer face and said overlying member inner face to one another.

3. The force sensor of claim 1, wherein said projection has a conical configuration.

4. The force sensor of claim 1, wherein said channel has a cylindrical configuration.

5. The force sensor of claim 1, wherein said base member has a base member outer perimeter defining a base member footprint and said overlying member has an overlying member outer perimeter defining an overlying member footprint, and wherein said overlying member footprint is greater than said base member footprint such that said overlying member fully covers and extends beyond said base member outer perimeter.

6. The force sensor of claim 1, wherein said force member has a force sensor surface area and said force sensor is dimensioned so that said force sensor surface area is substantially less than a lateral surface area of a golf club grip said force sensor is mountable on.

7. The force sensor of claim 1, wherein said overlying member has a Shore A durometer in a range between about 10 and about 30.

8. The force sensor of claim 1, wherein said base member has a Shore A durometer in a range between about 60 and about 90.

9. The force sensor of claim 1, wherein said relatively low resistance to elastic compressive deformation enables said overlying member to elastically deform to said compressed thickness value that is 75% or less of said ambient thickness value when said manual grasping force applied to said overlying member during the golf swing exceeds said maximum permissible force value.

10. A force sensor mountable on an outside lateral surface of a golf club grip comprising:

a base member having a substratum with a substratum inner face and a substratum outer face, a first projection, a second projection and a third projection, each said first, second and third projections positioned on said substratum outer face, and having a common projection height, wherein said base member has a relatively high resistance to elastic compressive deformation when a manual grasping force is applied to said base member during a golf swing; and an overlying member positioned atop said base member and having an overlying member inner face, an overlying member outer face, a first channel, a second channel and a third channel, each of said first, second and third channels extending from said overlying member inner face to said overlying member outer face and said first channel configured to receive said first projection in a first channel interior, said second channel configured to receive said second projection in a second channel interior and said third channel configured to receive said third projection in a third channel interior, wherein said overlying member has an overlying member thickness with an ambient thickness value greater than said common projection height when said overlying member is in an ambient state, and wherein said overlying member has a relatively low resistance to elastic compressive deformation, thereby reducing said overlying member thickness to a compressed thickness value less than said common projection height when a manual grasping force exceeding a maximum permissible force value is applied to said overlying member during the golf swing and extending said first, second and third projections out from said interiors of said first, second and third channels, respectively, beyond said overlying member outer face.

11. The force sensor of claim 10, wherein said overlying member inner face has an adhesive thereon enabling adherence of said base member outer face and said overlying member inner face to one another.

12. The force sensor of claim 10, wherein said first, second and third projections each has a conical configuration.

13. The force sensor of claim 10, wherein said first, second and third channels each has a cylindrical configuration.

14. The force sensor of claim 10, wherein said base member has a base member outer perimeter defining a base member footprint and said overlying member has an overlying member outer perimeter defining an overlying member footprint, and wherein said overlying member footprint is greater than said base member footprint such that said overlying member fully covers and extends beyond said base member outer perimeter.

15. The force sensor of claim 10, wherein said force member has a force sensor surface area and said force sensor is dimensioned so that said force sensor surface area is substantially less than a lateral surface area of a golf club grip said force sensor is mountable on.

16. The force sensor of claim 10, wherein said relatively low resistance to elastic compressive deformation enables said overlying member to elastically deform to said compressed thickness value that is 75% or less of said ambient thickness value when said manual grasping force applied to said overlying member during the golf swing exceeds said maximum permissible force value.

17. The force sensor of claim 10, wherein said first, second and third projections are aligned in series forming a single linear longitudinal projection column and are spaced a projection spacing distance apart from one another in said projection column.

18. The force sensor of claim 17, wherein said first, second and third channels are aligned in series forming a single linear longitudinal channel column and are spaced a channel spacing distance corresponding to said projection spacing distance apart from one another in said channel column.

19. A golf swing training method comprising:

mounting a force sensor on a grip outside lateral surface of a golf club, wherein said force sensor includes a base member having a substratum with a substratum inner face and a substratum outer face and a projection on said substratum outer face having a projection height, said base member having a relatively high resistance to elastic compressive deformation when a manual grasping force is applied to said base member during a golf swing, wherein said force sensor further includes an overlying member positioned atop said base member, wherein said overlying member has an overlying member inner face, an overlying member outer face, a channel extending from said overlying member inner face to said overlying member outer face, wherein said channel is configured to receive said projection in a channel interior, and wherein said overlying member has a relatively low resistance to elastic compressive deformation when said manual grasping force is applied to said overlying member during said golf swing and has an overlying member thickness with an ambient thickness value greater than said projection height when said overlying member is in an ambient state;

performing said golf swing while holding said golf club with a user's hand in contact with said force sensor, thereby applying said manual grasping force to said overlying member; and elastically deforming said overlying member to reduce said overlying member thickness to a compressed thickness value less than said projection height when said manual grasping force applied to said overlying member during said golf swing exceeds a maximum permissible force value, thereby enabling said projection to extend out from said channel interior beyond said overlying member outer face and engage said user's hand.

20. The golf swing training method of claim 19, wherein said golf club is a first golf club, said grip outside lateral surface is a first grip outside lateral surface, said force sensor is a first force sensor, said base member is a first base member, said substratum is a first substratum, said projection is a first projection, said height of said projection is a first projection height and said overlying member is a first overlying member, said method further comprising, mounting a second force sensor on a second grip outside lateral surface of a second golf club, wherein said second force sensor includes a second base member having said same relatively high resistance to elastic compressive deformation club as said first base member and a second overlying member substantially identical to said first overlying member, said second base member including a second substratum substantially identical to said first substratum and a second projection having a second projection height different than said first projection height, said second overlying member positioned atop said second base member on said second grip outside lateral surface and having a second channel configured to receive said second projection in a second channel interior, and wherein said second overlying member thickness has an ambient thickness value greater than said second projection height when said second overlying member is in an ambient state;

performing a golf swing while holding said second golf club with said user's hand in contact with said second force sensor, thereby applying a manual grasping force to said second overlying member; and elastically deforming said second overlying member to reduce said overlying member thickness to a second compressed thickness value less than said second projection height when said manual grasping force applied to said second overlying member during said golf swing exceeds a second maximum permissible force value, thereby enabling said second projection to extend out from said interior beyond said overlying member outer face and engage said user's hand.

* * * * *